US009618202B2

(12) United States Patent
Lubanowski

(10) Patent No.: US 9,618,202 B2
(45) Date of Patent: Apr. 11, 2017

(54) BURN BARREL

(71) Applicant: Chester J. Lubanowski, Ottawa, IL (US)

(72) Inventor: Chester J. Lubanowski, Ottawa, IL (US)

( * ) Notice: Subject to any disclaimer, the term of this patent is extended or adjusted under 35 U.S.C. 154(b) by 477 days.

(21) Appl. No.: 14/213,725

(22) Filed: Mar. 14, 2014

(65) Prior Publication Data

US 2014/0261374 A1 Sep. 18, 2014

Related U.S. Application Data

(60) Provisional application No. 61/794,915, filed on Mar. 15, 2013.

(51) Int. Cl.

| | |
|---|---|
| ***F23G 5/40*** | (2006.01) |
| ***F23H 17/08*** | (2006.01) |
| ***F23G 5/00*** | (2006.01) |
| ***F23G 5/24*** | (2006.01) |
| ***F23H 9/00*** | (2006.01) |

(52) U.S. Cl.

CPC ..... *F23G 5/40* (2013.01); *F23G 5/002* (2013.01); *F23G 5/245* (2013.01); *F23H 9/00* (2013.01); *F23H 17/08* (2013.01); *F23G 2203/401* (2013.01); *F23G 2203/403* (2013.01)

(58) Field of Classification Search

CPC ... F23G 5/24; F23G 5/245; F23G 5/40; F23G 5/42; F23G 2203/401; F23G 2203/403

See application file for complete search history.

(56) References Cited

U.S. PATENT DOCUMENTS

| | | | | |
|---|---|---|---|---|
| 643,593 A | | 2/1900 | Cox | |
| 920,312 A | | 5/1909 | Fox | |
| 989,417 A | | 1/1911 | Raggio | |
| 1,769,003 A | * | 7/1930 | Strube | F23G 5/42 110/259 |
| 1,955,641 A | * | 4/1934 | Lane | F23G 5/42 110/217 |

(Continued)

OTHER PUBLICATIONS

Kenny's Burn Barrels, Accessories and Replacement Parts for Burn Barrels, www[dot]kennysburnbarrels[dot]com, earliest known publication date Feb. 17, 2002.

(Continued)

*Primary Examiner* — David J Laux

(74) *Attorney, Agent, or Firm* — Cherskov Flaynik & Gurda, LLC

(57) ABSTRACT

Briefly, the invention provides an incinerator comprising a housing suspended above the ground. The housing is without a top or bottom, but includes an elongated member supporting the housing and a grate intermediate of the housing and the elongated member. Also provided is a device for aiding combustion reactions. The device includes a vertically disposed stanchion, a housing, a first open end and a second open end. The housing is supported at the second open end by the stanchion. The device also include a grid with a cross section identical to the cross section of the housing. The diameter of the cross section of the grid is less than the diameter of the cross section of the housing and the grid in rotates around the stanchion.

14 Claims, 6 Drawing Sheets

(56) References Cited

U.S. PATENT DOCUMENTS

| | | | | | |
|---|---|---|---|---|---|
| 2,124,320 | A * | 7/1938 | Tarment | F23G 5/42 | 110/217 |
| 2,271,828 | A * | 2/1942 | Peacock | F23G 5/42 | 110/217 |
| 2,737,911 | A * | 3/1956 | Mims | F23G 5/42 | 110/217 |
| 2,936,724 | A | 5/1960 | Bishop | | |
| 3,111,097 | A * | 11/1963 | Dodge | F23G 5/24 | 110/240 |
| 5,347,935 | A * | 9/1994 | Whitaker | F23G 7/10 | 110/240 |
| 6,932,001 | B2 | 8/2005 | Wilfer | | |
| 7,438,003 | B2 | 10/2008 | Wilfer | | |
| 2009/0211501 | A1* | 8/2009 | O'Connor | F23G 5/40 | 110/240 |

OTHER PUBLICATIONS

DR Power Equipment, BurnCage, www[dot]drpower[dot]com/shop-by-category/burncage/burn-cage[dot]axd, earliest known publication date Feb. 7, 2013.

Burn Right Products LLC, The Hi-Temp Mini-Incinerator, www[dot]burnrightproducts[dot]com, earliest known publication date Aug. 6, 2003.

* cited by examiner

FIG. 8G
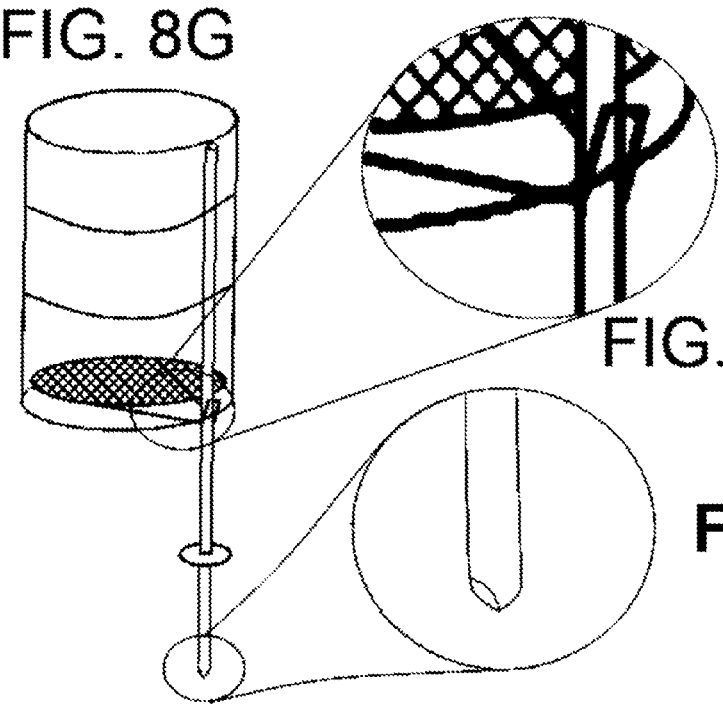
FIG. 8H
FIG. 8I
FIG. 8K
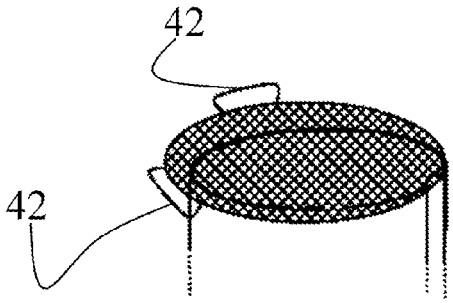
FIG. 8J
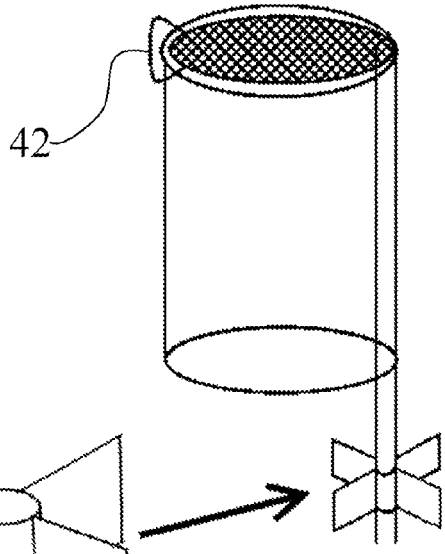
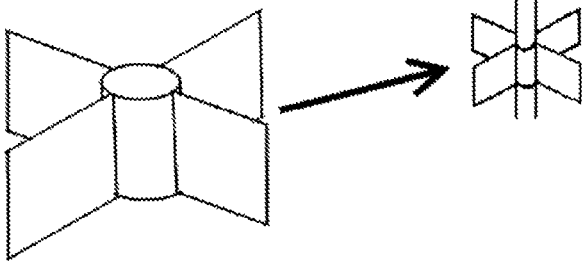
FIG. 8L

BURN BARREL

PRIORITY

This utility application claims the benefit of U.S. Provisional Patent Application No. 61/794,915, filed on Mar. 15, 2013, the entirety of which is incorporated herein by reference.

BACKGROUND OF THE INVENTION

1. Field of the Invention

This invention relates to a device for burning bulk material, and more specifically this invention relates to an outdoor incinerator.

2. Background of the Invention

Burn barrels are common fixtures in rural and semi-rural areas. Most comprise typical 55 gallon drums with holes formed in their lower halves and perhaps in the bottom end of the drum. The problem with this typical configuration is multifold. First, complete burning is usually not achieved, at least without churning the burning material. This can lead to incomplete combustion if the barrel is left unattended, or burns, smoke exposure, and general unpleasantness to the churner.

Second, the inventor has found that forming ventilation holes into the sides and perhaps bottom of the drums results in an acceleration of corrosion to the drums. The barrels therefore need replacement well before the end of their useful burning life.

Efforts have been made to advance the burn barrel art, those efforts including supporting a barrel on the ground, but suspending a bottom grate inside the barrel so that the grate is above the ground. This can lead to corrosion to the bottom lip of the barrel due to it being in constant contact with the ground.

Other burn barrel designs comprise suspending a barrel or housing off the ground whereby the bottom of the barrel or housing is supported by bricks or some other non-combustible substrate. Air exchange afforded in these designs are also not optimal.

Some burn barrel designs allow for a side door to a bottom half of the barrel. As noted supra, forming apertures into an already formed barrel or housing tends to accelerate corrosion of the housing.

Also, none of the art discussed supra, or otherwise known by the inventor allows for easy removal or access of a grate viz. an incinerator housing.

A need exists in the art for an incinerator, primarily used outdoors, which optimizes airflow into the incinerator to facilitate complete burning of bulk material. The incinerator should be modular in design to afford easy dissembly and cleaning. The incinerators should be transportable. The incinerator should be made from readily available materials.

SUMMARY OF INVENTION

An object of the invention is to provide an incinerator which overcomes many of the drawbacks of the prior art.

Another object of the invention is to provide an incinerator which optimizes airflow with the ambient environment. A feature of the invention is a bottom-less incinerator housing not in contact with the ground. An advantage of the invention is optimized combustion of materials contained by the incinerator.

Still another object of the invention is to provide a burn barrel system which effectuates complete thermal decomposition of combustible materials. A feature of the invention is that a combustion chamber housing is suspended above the ground so as not to contact the ground. An advantage of the invention is that it utilizes natural thermal convection to draw ambient air into the housing during burning operations.

Briefly, the invention provides an incinerator comprising a housing suspended above the ground, said housing without a top or bottom, an elongated member supporting the housing; and a grate intermediately disposed the housing and the elongated member.

Also provided is a device for aiding combustion reactions, the device comprising a vertically disposed stanchion; a housing defining a cross section, a first open end and a second open end, said housing supported at said second open end by said stanchion; and a grid having a cross section identical to the cross section of the housing, whereby the diameter of the cross section of the grid is less than the diameter of the cross section of the housing, the grid in rotatable communication with said stanchion.

BRIEF DESCRIPTION OF DRAWING

The invention together with the above and other objects and advantages will be best understood from the following detailed description of the preferred embodiment of the invention shown in the accompanying drawings, wherein:

FIG. 8A-L depicts alternative means for supporting internally disposed burn grids and also alternative means for supporting the entire system, in accordance with features of the present invention.

DETAILED DESCRIPTION OF THE INVENTION

The foregoing summary, as well as the following detailed description of certain embodiments of the present invention, will be better understood when read in conjunction with the appended drawings.

As used herein, an element or step recited in the singular and preceded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The invention provides a burn barrel for incinerating and otherwise thermally decomposing bulk material. A salient feature of the device is that the burn barrel is supported at one side by an elongated support, such that the barrel can be rotated about the longitudinal axis of the support at infinite points. The advantage of this configuration is that it facilitates easier removal of detritus from underneath the barrel, which would otherwise collect in an inaccessible location on the ground as a result of a standard burn barrel remaining static over the ground and/or contacting the ground.

Figure 1:
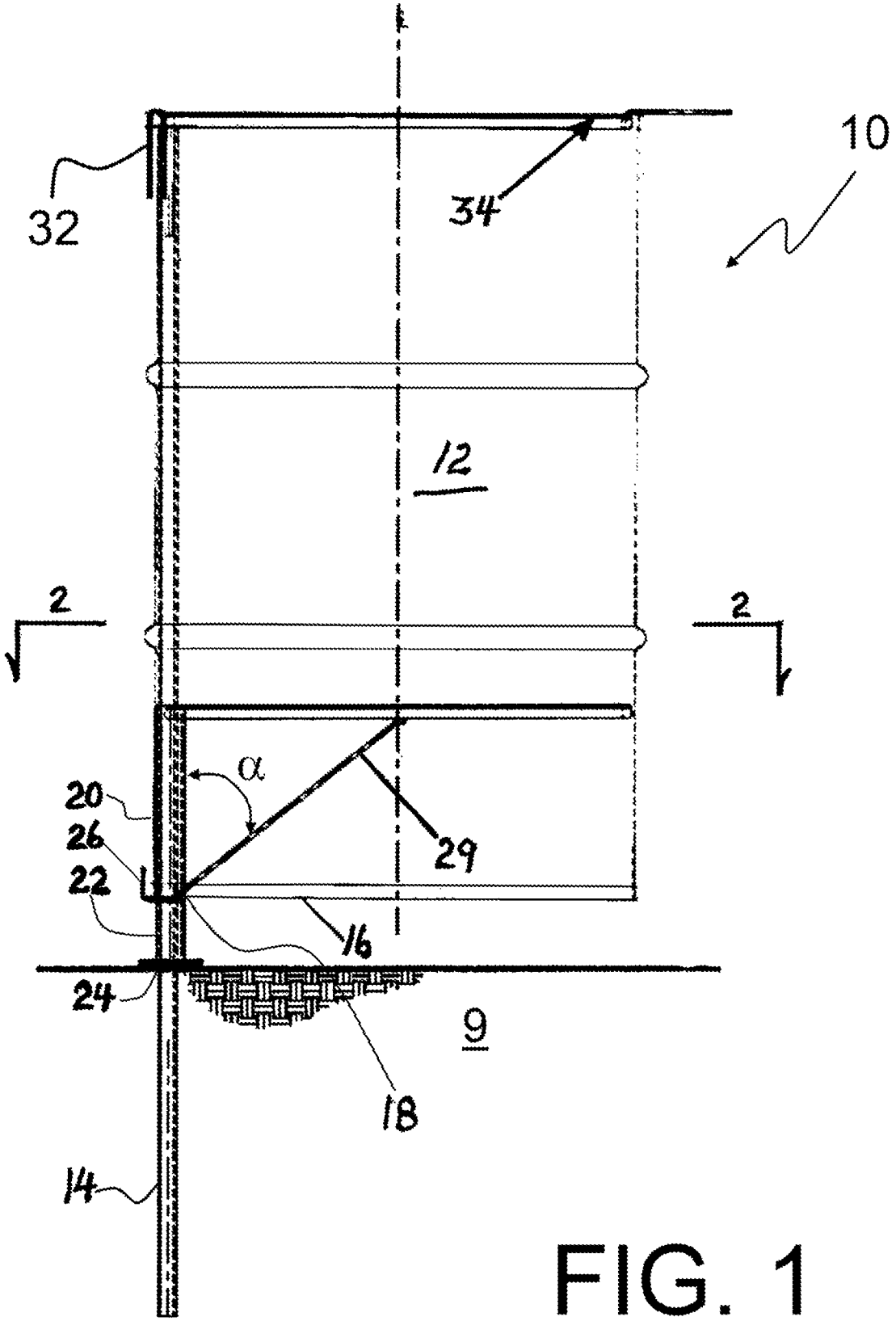
FIG. 1 in an elevated view of an incineration device, in accordance with features of the present invention.

FIG. 1 is an elevational view of a preferred embodiment of the device, the device designated as numeral 10. FIG. 1 depicts an incineration housing 12 suspended above the ground 9. This suspension is affected by a column 14 or stanchion such as a rigid hollow rod, solid rod (e.g., a reinforcement bar), a solid rod with a hollowed out end, a pipe, a stake, or similar substrate. The column may be comprised of any rigid noncombustible material, including but not limited to metal (e.g., ferrous and nonferrous material), ceramic, cement, or a combination thereof. Any material rigid enough to support a cantilevered housing 12 as shown in a substantially vertical position is suitable. Inasmuch as a 55 gallon barrel sans a top and bottom weighs approximately only 35 to 45 pounds, a myriad of rigid yet lightweight stock is suitable. For example, an exemplary support column is standard ½" black pipe (or rebar) or ¾" black pipe (or rebar).

In an embodiment of the invention, the housing consists of a cylinder, that is a structure defining longitudinally extending surfaces but lacking an integrally formed top surface and lacking an integrally formed bottom surface. An exemplary housing is a 55 gallon barrel with its top and bottom removed.

As noted supra, the housing 12 is suspended over the ground in a cantilevered configuration viz the support column 14. In this embodiment, only a proximal portion 18 of a depending lip 16 of the housing 12 is indirectly supported by the support column 14. Good results are obtained when the support column 14 is embedded into the ground approximately 1 foot in depth when support of a 55 gallon drum is desired. A 55 gallon drum has an inner diameter of approximately 22.5 inches and a weight of approximately 39-40 pounds.

Housing Support

Assembly Detail

A salient feature of the invention is that the combustion housing 12 is supported at substantially one point, that point in rotatable communication with the support column 14. A sleeve 20 having a first end and a second end inferior to the first end, is adapted to be received by the support column 14, so as to be in rotatable communication with the support column. A radially directed protuberance 26 positioned between the first and second ends of the sleeve extend from the sleeve and is adapted to removably contact the proximal region 18 of the housing. The protuberance 26 terminates in an upwardly extending arm so as to prevent the depending lip from slipping off of the protuberance. The upwardly extending arm 28 defines an annular space to the housing wide enough to allow unencumbered placement and removal of the lip of the housing onto and from the protuberance 26 of the lip.

Figure 2:
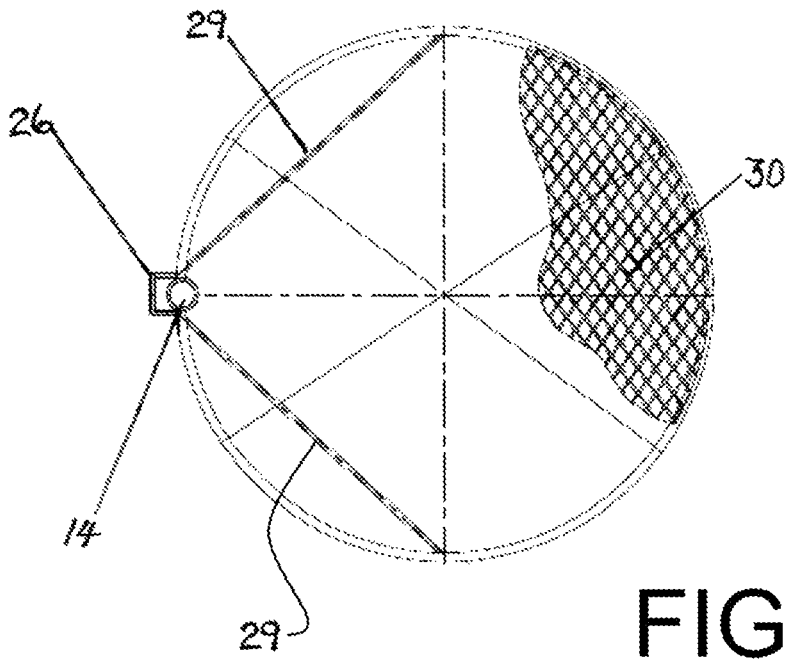
FIG. 2 is view of FIG. 1 taken along line 2-2, in accordance with features of the present invention.
Figure 3:
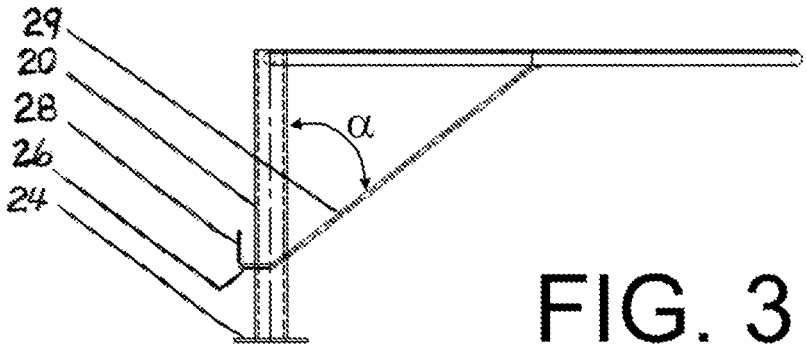
FIG. 3 is a view of an incinerator housing ground support structure, in accordance with features of the present invention.

A depending end 22 of the sleeve terminates in a flared surface 24. This flared surface 24 defines a radially extending disk-shaped flange adapted to contact the surface of the ground 9. The diameter of the disk is chosen to prevent the sleeve 20 from being driven into the ground by the weight of the device 10 and perhaps the weight of the material being combusted contained by the device. As depicted in FIG. 2, a medially disposed region of a superior end 21 of the sleeve 20 is attached to a proximal edge of a horizontally disposed porous substrate 30, such as a grid. A myriad of attachment means are suitable, including welds, snap fit configurations, nut and bolt configurations or friction fit configurations. That the grid is attached to a medially disposed region of the superior end allows the entire sleeve-first grid assembly to reside within the housing 12, and be surrounded by the housing. Simultaneously, this attachment configuration adapts the sleeve to be slidably received by the support stanchion 14. That portion of the support stanchion resides within the sleeve 20 but lateral from the grid position, relative to the longitudinal axis a of the housing 12.

Bottom Grid

Assembly Detail

Also positioned between the first and second ends of the sleeve 20 is one or a plurality of medially-extending brackets, 29. These brackets 29, a first or proximal end of each of which is attached to the sleeve, serve as a means to support a horizontally disposed porous substrate 30. Suitable porous substrates include, but are not limited to, expanded metal substrate, such as wire webbing, wire mesh, wire grating, or screen. In an embodiment of the invention, a ¾×9 expanded grate is utilized.

The grate 30 has a cross section smaller than the cross section of the housing so that its periphery is surrounded by an interior surface of the housing. For example, in the case where a standard 55 gallon drum is utilized as the incinerator housing 12, the grate would have an outer diameter of approximately 22 inches. In an embodiment of the invention, the medially extending brackets 29 extend upwardly at an angle a relative to the longitudinal axis of the sleeve 20 to assure that the grate 30 maintains its horizontal disposition with anticipated weight loadings of combustible materials. In an embodiment of the invention that angle ranges from approximately 45 and 75 degrees, with 3/16" round bar comprising the brackets.

An embodiment of the device comprises a hollow core support column 14 such as a pipe. This enables the use of an upside down, elongated "U"-shaped clamp 32 to engage both the first lip of the housing 12 proximal to the support column 14, and interior regions of the hollow core of the support column 14. Once so positioned, the "U" shaped clamp 32 prevents the top of the housing from tipping away from the support column 14 when the housing is supported by the sleeve 20.

Aside from accommodating a downwardly depending leg of the "U" shaped clamp 32, the diameter of the hollow core of the support column is also chosen to accommodate an anchor pin 36 of a top grid assembly of the device.

Figure 7:
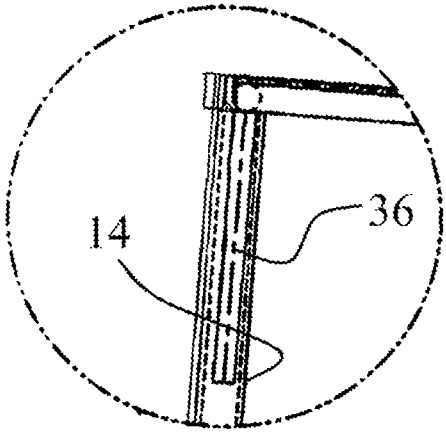
FIG. 7 is a cutaway view showing alternative positioning of pivot points of various aspects of a burn barrel, in accordance with features of the present invention.

Surprisingly and unexpectedly, the inventor found that the "U" shaped clamp 32 is not necessary. This alternative embodiment is depicted in FIG. 7. That the U-shaped clip 32 is due to a combination of the weight of the entire housing 12 resting on a horizontally disposed, laterally directed surface of the protuberance 26 and the housing leaning against the vertical support column 14.

Top Grid

Assembly Detail

Figure 4:
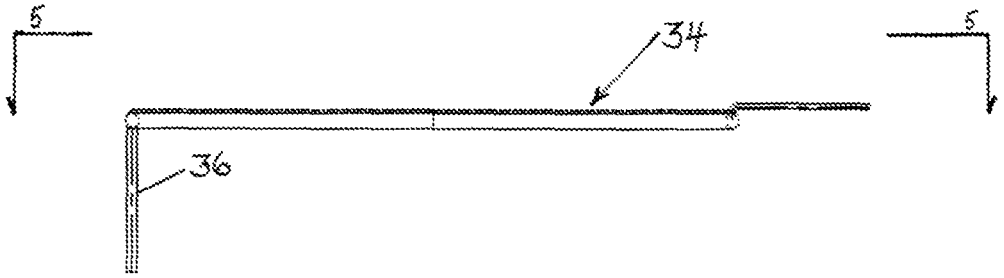
FIG. 4 is an elevation view of a top grid assembly, in accordance with features of the present invention.
Figure 5:
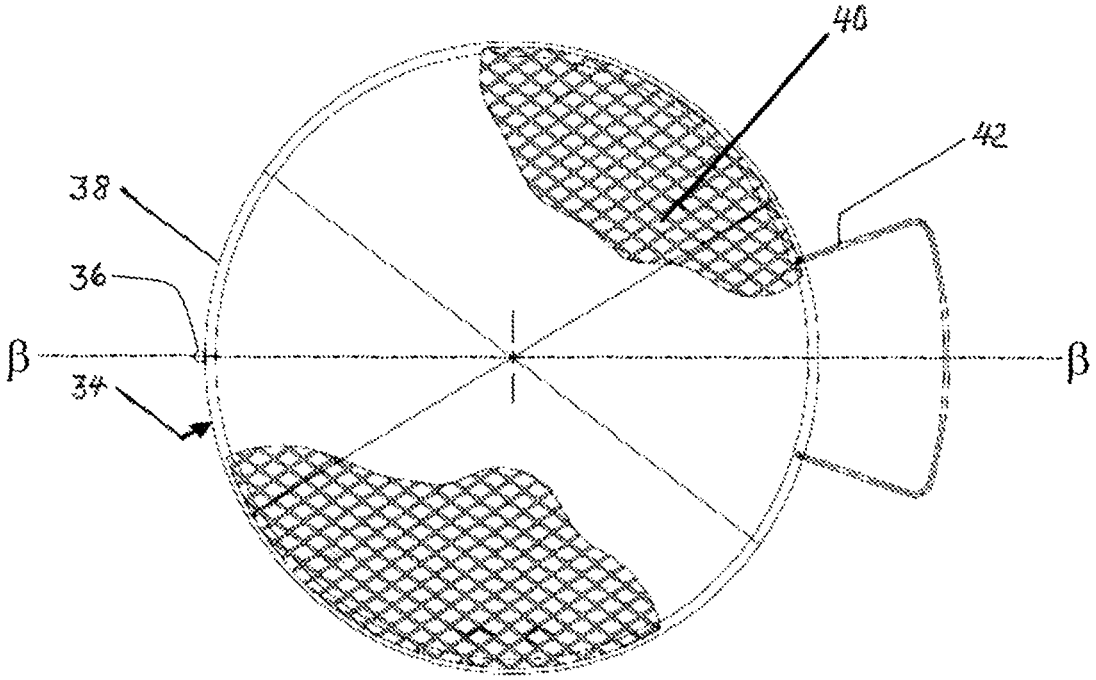
FIG. 5 is a view of FIG. 4 taken along line 5-5, in accordance with features of the present invention.
Figure 6:
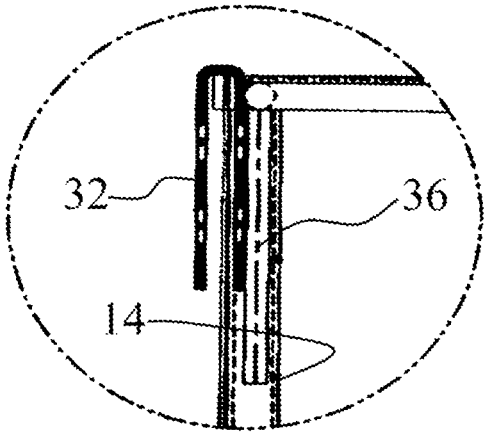
FIG. 6 is a cutaway view showing positioning of pivot points, in accordance with features of the present invention.

FIG. 4 is an elevational view and FIG. 5 is a plan view of the top grid assembly, the top grid assembly designated generally as numeral 34. FIG. 6 is a close up view of the interaction between the "U"-shaped clamp 32, the elongated pipe 14 serving as the anchoring point for the device, and the anchor pin 36 for the top grid assembly.

The top grid assembly 34 comprises a frame 38 encircling a thermal resistant porous substrate 40 defining a plane, and the aforementioned anchor pin 36. The grid assembly 34 has an outer diameter less than the inner diameter of the housing 12. This serves as a means to disperse ash lifted from the burning material via thermal convection. The top grid assembly 34 also serves to prevent inadvertent entry into the housing by the user during burn operations.

A first (i.e., proximal) end of the pin is attached to the frame and extends at an angle which is approximately 90 degrees relative to the plane formed by the porous substrate. A second (i.e. distal) end of the pin 36 depends downwardly and is adapted to be received by the hollow cavity defined by the support column 14. This arrangement allows the top grid assembly to pivot off center from the housing to facilitate loading of material targeted for combustion.

Suitable porous substrates include, but are not limited to, expanded metal substrate, such as wire webbing, wire mesh, wire grating, or screen. In an embodiment of the invention, the porous substrate 40 comprises ½×16-18 expanded metal.

The top grate 40 is attached to the frame 38 via tack welds, snap fit arrangements, bolt/nut configurations, or a combination of these attachment means. Alternatively, the porous substrate 40 is not surrounded by a frame but rather defines the periphery of the top grid assembly 34.

The top grid assembly 34 further comprises a radially extending loop 42 defining a handle 42. The handle 42 extends from a peripheral region of the top grid assembly 34 so as to be generally directly opposite the assembly's anchor pin 36, such that the proximal end of the pin 36, and a mid point of the handle fall along a line running through the center of the assembly 34, that line designated as 11 in FIG. 5.

In operation, the housing 12 is supported by the support column, and the bottom grid 30 is coaxially aligned with the housing 12. The top grid 34 is positioned so as to be noncoaxially aligned with the housing. This allows top loading of the housing 12 with material targeted for thermal decomposition.

After the device is loaded, the material targeted for thermal decomposition is set afire. Then, the top grid 34 is pivoted into coaxial alignment with both the housing 12 and the bottom grid 30. Upon substantial combustion of the material targeted for thermal decomposition, the housing is pivoted out of coaxial alignment with the bottom grid so that inspection of the grid can commence.

Replacement/removal of the housing from the support column 14 is accomplished by first removing the top grid assembly 34, then sliding the housing upwardly until it clears the superior end of the support column 14.

Generally, the device 10 comprises thermally resistant material, such as metal (ferrous and non-ferrous), metal alloy, ceramic, porcelain, and composite materials. A preferred embodiment of the device comprises a housing 12 lacking any integrally molded top or bottom surfaces. Also, the housing lacks any apertures in any of its sides as it has been the inventor's experience that such apertures accelerates corrosion, particularly after repeated thermal cycling.

It is to be understood that the above description is intended to be illustrative, and not restrictive. The above-described embodiments (and/or aspects thereof) may be used in combination with each other. For example, more than one housing may be accommodated by a single support column. This essentially results in a doubling of thermal waste reduction capacity. In the case of the grate assembly, more than one handle 42 may be provided.

Figure 8A:
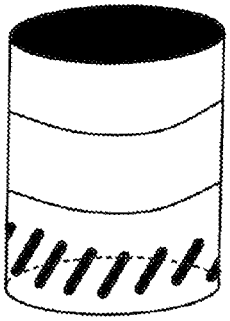
Figure 8B:
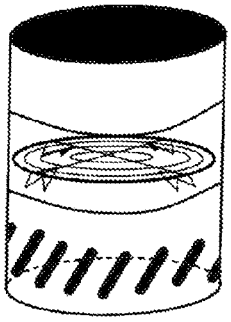

Also, and as depicted in FIG. 8A-H, a myriad of bottom grid support configurations are utilized. Some of these supports (e.g. as depicted in FIG. 8B) are welded protuberances directed medially from the interior surfaces of the housing 12. The grid rests upon these protuberances so as to be encircled by the interior surfaces of the housing.

Figure 8C:
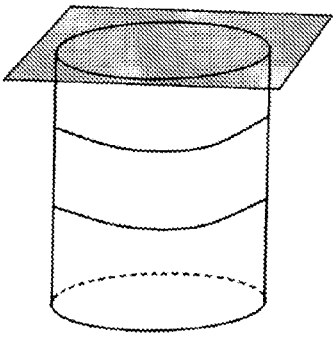
Figure 8D:
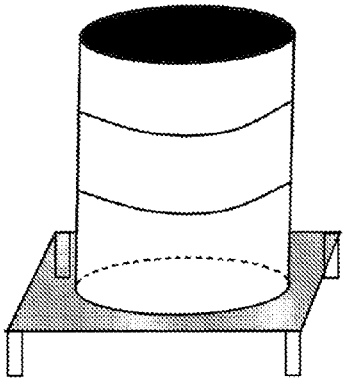

FIG. 8A depicts a housing 12 with slots cut near the portion of the housing proximal to the ground. FIG. 8B depicts a housing 12 with interior protuberances that support a grill grate. FIG. 8C depicts a bottomless housing 12 with a mesh screen cover. FIG. 8D is also depicts a bottomless housing 12 but with a mesh platform elevating the housing 12 from the ground.

Figure 8E:
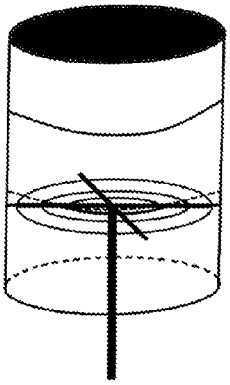

FIG. 8E depicts a center support for a burn grid, that support substantially coaxially aligned with the longitudinal axis a of the housing 12. The center support is attached at substantially right angles to the plane formed by cross pieces horizontally disposed. The cross pieces provide a means for supporting the grid which overlays the cross pieces.

Figure 8F:
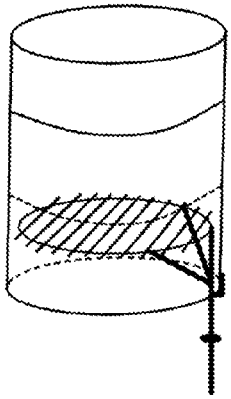

FIG. 8F depicts an embodiment in which a hoop is welded to the support column 14. Grates are then welded across the hoop to provide a substrate to support the material to be burned. Further welded to the column 14 is a piece of angle iron, which serves to support the housing 12 and lift it off the ground.

FIG. 8G depicts an embodiment in which a circular metal mesh is supported on the interior of the housing 12 by support arms welded to the support column 14. The support arms extend past the support column 14 to form a barrel support rim. FIG. 8H is a detail view of the support rim. At the downstream end of the support column 14 is a crimped pipe end, which facilitates driving the support column 14 into the ground. A detail view of the crimp can be seen in FIG. 81.

FIG. 8J depicts an oversized mesh screen lid, featuring two handles 42 separated at approximately a 90 degree arc along the periphery of the lid, that region of the periphery approximately opposite to the periphery region in rotatable communication with the housing 12. The screen also has the ability to swivel on the support column 14.

FIG. 8K depicts an alternative means for preventing the support column 14 from either tilting to one side, or sinking into the earth when fully loaded. An X-shaped collar is placed on the support column 14. A detail view of the collar can be seen in FIG. 8L. The collar contacts the ground and stabilizes the support column against shifts in the weight of the housing 12 contents.

FIG. 8K also depicts a single handle projecting radially from a distal portion of the periphery of the top grid assembly 34.

In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is Claimed is defined as follows:

1. An incinerator comprising:

a housing suspended above a ground, said housing without a top or a bottom;

an elongated member supporting only one side of the housing such that the housing can be rotated about the elongated member; and a grate intermediately disposed of the housing and the elongated member.

2. The incinerator as recited in claim 1 wherein the grate is in rotatable communication with the elongated member.

3. The incinerator as recited in claim 1 wherein the grate is attached to a first end of a sleeve wherein the sleeve is adapted to be received by a stanchion, and a second end of the sleeve terminates in a flared surface for preventing the stanchion from sinking into the ground.

4. The device as recited in claim 3 wherein the sleeve is welded to the grid.

5. The incinerator as recited in claim 1 wherein the housing has a bottom opening defining a first plane and the grate defines a second plane parallel with and inferior to said first plane.

6. The incinerator as recited in claim 1 wherein the housing defines longitudinally extending surfaces and the housing lacks a bottom surface and a top surface integrally formed with said surfaces.

7. A device for aiding combustion reactions, the device comprising:

a. a vertically disposed stanchion;

b. a housing defining a cross section, a first open end and a second open end, said housing supported at only one side of said second opening end by said stanchion such that the housing can be rotated about the stanchion ; and c. a first grid having a cross section identical to the cross section of the housing, whereby the diameter of the cross section of the grid is less than the diameter of the cross section of the housing, the grid positioned in registration with the housing and the grid in rotatable communication with said stanchion.

8. The device as recited in claim 7 further comprising a second grid superior of the first grid wherein said second grid is coaxially aligned with said housing in a first configuration and wherein said second grid is non coaxially aligned with said housing in a second configuration.

9. The device as recited in claim 8 wherein the second grid comprises a substantially horizontally disposed substrate and a protuberance extending at approximately a 90 degree angle from the horizontally disposed substrate.

10. The device as recited in claim 9 wherein the protuberance is adapted to be received by interior regions of the stanchion.

11. The device as recited in claim 7 wherein a depending end of said stanchion is embedded into a horizontal support surface.

12. The device as recited in claim 11 wherein the first grid is in rotatable communication with the horizontal support surface.

13. The device as recited in claim 11 wherein the first grid comprises a substantially horizontally disposed substrate and a substantially vertically disposed depending member in rotatable communication with the stanchion.

14. The device as recited in claim 13 wherein the depending member terminates in a substantially horizontally disposed plate having a diameter larger than the diameter of the depending member.

* * * * *